US008353543B2

(12) United States Patent
Harrison

(10) Patent No.: US 8,353,543 B2
(45) Date of Patent: Jan. 15, 2013

(54) LOCKING ARRANGEMENT FOR A DOOR

(75) Inventor: Andrew Charles Harrison, Telford (GB)

(73) Assignee: Loksys Ltd., Manchester (GB)

( * ) Notice: Subject to any disclaimer, the term of this patent is extended or adjusted under 35 U.S.C. 154(b) by 542 days.

(21) Appl. No.: 12/376,505

(22) PCT Filed: Aug. 8, 2007

(86) PCT No.: PCT/GB2007/003019

§ 371 (c)(1),
(2), (4) Date: Apr. 29, 2009

(87) PCT Pub. No.: WO2008/017841

PCT Pub. Date: Feb. 14, 2008

(65) Prior Publication Data

US 2010/0181782 A1 Jul. 22, 2010

(30) Foreign Application Priority Data

Aug. 10, 2006 (GB) ..... 0615853.9

(51) Int. Cl.

| | |
|---|---|
| ***E05C 3/04*** | (2006.01) |
| ***E05C 9/12*** | (2006.01) |
| ***E05C 19/06*** | (2006.01) |
| ***E05B 67/38*** | (2006.01) |
| ***E05B 65/00*** | (2006.01) |

(52) U.S. Cl. ..... 292/207; 70/56; 70/77; 292/336.3; 292/259 R

(58) Field of Classification Search ..... 70/54–56, 70/417, 50, 51, 202, 203, 211, 212, DIG. 43, 70/DIG. 56; 292/148, 205, 218, 208, 281–286, 292/DIG. 32

See application file for complete search history.

(56) References Cited

U.S. PATENT DOCUMENTS

| | | | | |
|---|---|---|---|---|
| 2,374,585 | A | 3/1945 | Conlan | |
| 2,997,752 | A * | 8/1961 | Henrikson et al. | 49/143 |
| 3,217,661 | A * | 11/1965 | Kemp | 105/377.08 |
| 3,312,493 | A * | 4/1967 | Olander | 292/218 |
| 3,415,085 | A * | 12/1968 | Eble, Jr. | 70/232 |

(Continued)

FOREIGN PATENT DOCUMENTS

| | | |
|---|---|---|
| GB | 2062084 | 5/1981 |

(Continued)

OTHER PUBLICATIONS

International Search Report and Written Opinion, Corresponding to International Application No. PCT/GB07/03019, mailed Oct. 30, 2007.

*Primary Examiner* — Thomas Beach
*Assistant Examiner* — Faria Ahmad
(74) *Attorney, Agent, or Firm* — Greenlee Sullivan P.C.

(57) ABSTRACT

A locking arrangement for a door includes an upright operating bar (1) mounted on the door for angular movement about its axis and a handle (3) which is connected to the operating bar by a pivotal connection for engagement with a closure mechanism (7,8). The handle and the closure mechanism include co-operating apertures (9). A housing (11) is adapted to cover the pivotal connection of the handle and at least a part of the closure mechanism. A releasable securing means (35) passes through apertures formed in both the handle and the closure mechanism and secures the housing relative to the handle and the closure mechanism.

7 Claims, 6 Drawing Sheets

U.S. PATENT DOCUMENTS

| | | | | |
|---|---|---|---|---|
| 3,451,705 | A * | 6/1969 | Turpen | 292/218 |
| 3,484,127 | A * | 12/1969 | Pastva | 292/218 |
| 3,606,423 | A * | 9/1971 | McCarthy | 92/148 |
| 3,664,695 | A * | 5/1972 | Sickel | 92/54 |
| 4,581,907 | A * | 4/1986 | Eberly | 70/54 |
| 5,024,473 | A * | 6/1991 | McQuade | 292/120 |
| 5,103,658 | A * | 4/1992 | McQuade | 70/77 |
| 5,154,458 | A * | 10/1992 | Cook et al. | 292/218 |
| 5,737,946 | A * | 4/1998 | Sole et al. | 70/54 |
| 5,775,747 | A * | 7/1998 | Navarsky | 292/307 B |
| 6,010,166 | A * | 1/2000 | Hamilton et al. | 292/282 |
| 6,357,266 | B1 * | 3/2002 | Van Buren | 70/56 |
| 6,442,982 | B1 * | 9/2002 | Larsen et al. | 70/3 |
| 6,519,982 | B1 * | 2/2003 | Brammall et al. | 70/56 |
| 6,553,798 | B1 * | 4/2003 | Larsen et al. | 70/211 |
| 6,581,419 | B1 * | 6/2003 | Strodtman | 70/56 |
| 6,601,413 | B1 * | 8/2003 | Vito | 70/56 |
| 6,609,739 | B1 * | 8/2003 | Avganim | 292/295 |
| 6,823,701 | B1 * | 11/2004 | Gogel | 70/32 |
| 6,846,024 | B1 * | 1/2005 | Palzkill | 292/261 |
| 6,928,843 | B1 * | 8/2005 | Pirnie | 70/54 |
| 6,962,066 | B2 * | 11/2005 | Larsen et al. | 70/3 |
| 7,063,362 | B1 * | 6/2006 | Liroff | 292/315 |
| 7,210,316 | B1 * | 5/2007 | Falconer et al. | 70/2 |
| 7,272,963 | B2 * | 9/2007 | Rosenberg et al. | 70/126 |
| 7,278,284 | B1 * | 10/2007 | James | 70/56 |
| 7,341,305 | B2 * | 3/2008 | Reynard | 296/186.4 |
| 7,412,856 | B1 * | 8/2008 | Gogel | 70/56 |
| 7,441,425 | B2 * | 10/2008 | Jeong | 70/56 |
| 7,921,685 | B2 * | 4/2011 | Teskey | 70/208 |
| 2004/0221626 | A1 * | 11/2004 | Palzkill et al. | 70/34 |
| 2005/0144991 | A1 * | 7/2005 | Bravo et al. | 70/56 |
| 2006/0201210 | A1 * | 9/2006 | Gogel | 70/56 |
| 2007/0024064 | A1 * | 2/2007 | Carter | 292/281 |

FOREIGN PATENT DOCUMENTS

| | | |
|---|---|---|
| GB | 2314585 | 1/1998 |
| GB | 2330377 | 4/1999 |
| WO | WO 01/21914 | 3/2001 |

* cited by examiner

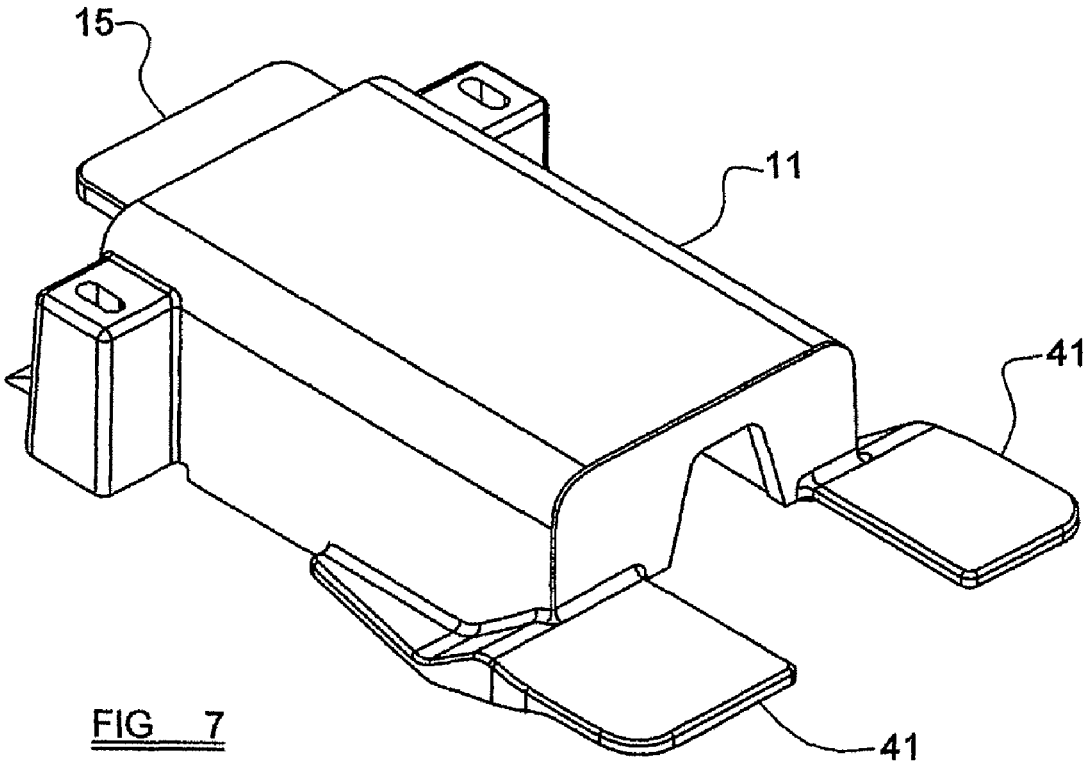
FIG 7
FIG 8
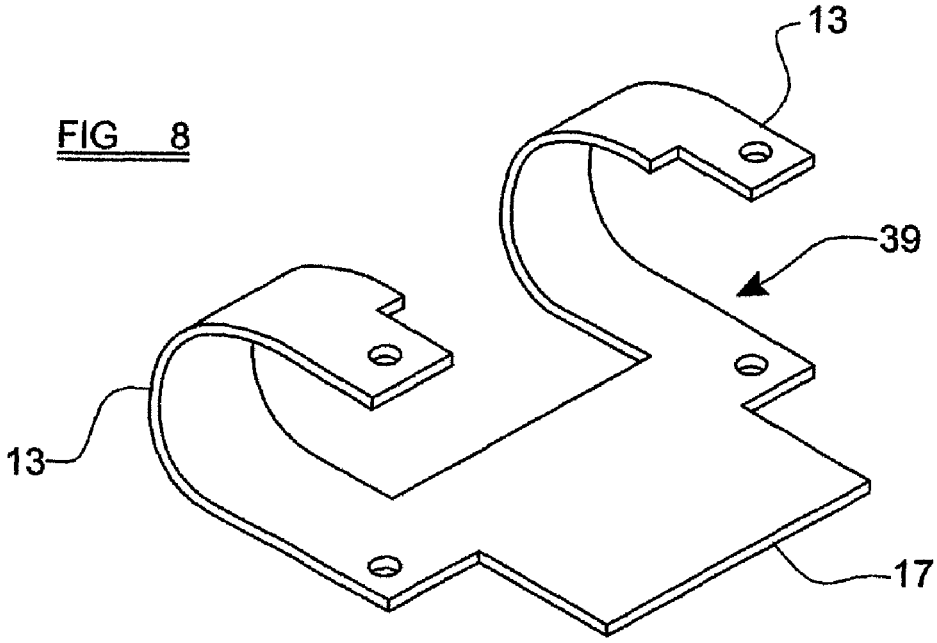

LOCKING ARRANGEMENT FOR A DOOR

CROSS-REFERENCE TO RELATED APPLICATIONS

This application is the U.S. national stage application under 35 U.S.C. §371 of International Application No. PCT/GB2007/003019, filed Aug. 8, 2007, which claims benefit of Great Britain Patent Application No. 0615853.9 filed Aug. 10, 2006, all of which are hereby incorporated by reference in their entirety to the extent not inconsistent with the disclosure herein.

This invention relates to a locking arrangement for a door, such as the door of a vehicle, trailer or freight container which is used for transportation of goods by road, rail or sea.

The present invention is concerned with door fastening mechanisms of the kind in which an upright operating bar adapted to be mounted in bearings on the door for angular movement about its axis carries on one or each end a fastening member for co-operation with a keeper on a door frame to which the door is hinged about an upright edge. The operating bar is moveable by a handle which is connected to the operating bar by a pivotal connection, conveniently including a pivot pin, such as a rivet, and which can be positively locked in a locked position corresponding to the full engagement of the or each fastening member with its keeper, by co-operation of the handle with a catch on the face of the door.

The handle may be secured to the catch by means of a padlock or a TIR seal.

There is considerable incentive, especially in the case of vehicles which carry dutiable goods across frontiers, for thieves to be able to break into freight containers, tamper with or steal the goods, and then seal the container again without leaving any obvious evidence of tampering. For example, thieves have found ways of disengaging the handle of a fastening mechanism to allow rotation of the operating bar without tampering with the padlock or TIR seal. The handle can then be re-engaged, albeit with adhesive or the like, to conceal the fact that pilfering has taken place.

It has previously been proposed to provide protecting devices around the region where the handle is connected to the operating bar, for example in GB-A-2 314 585 and in GB-A-2 330 377. However, such devices are not entirely effective in the face of increasingly sophisticated thieves. The device according to GB-A-2 330 377 is merely intended to provide a tamper-evident fastener, while the device according to GB-A-2 314 585 requires the device to be destroyed in order to be able to release the handle from its locked position which is inconvenient and uneconomical.

It is therefore an object of the present invention to provide an improved locking arrangement for a door.

According to the present invention there is provided a locking arrangement for a door, the locking arrangement including an upright operating bar mounted on the door for angular movement about its axis and a handle which is connected to the operating bar by a pivotal connection for engagement with a closure mechanism, the handle and the closure mechanism including co-operating apertures, the locking arrangement further comprising:

a housing adapted to cover the pivotal connection of the handle and at least a part of the closure mechanism;

a releasable securing means passing through apertures formed in both the handle and the closure mechanism and securing the housing relative to the handle and the closure mechanism.

The housing may be pivotably mounted on the operating bar, for example by way of one or more substantially U-shaped members. Alternatively, the housing may be pivotally mounted on the door. One or more of the U-shaped members or the housing may be provided with a retaining member which is adapted to be positioned behind the operating bar. The retaining member may be substantially triangular in shape.

The housing may be provided with a protective plate which extends at least partly across the operating bar. Thus, the protective plate may cover that region where the handle is pivotably mounted on the operating bar.

The housing may substantially enclose both the pivotal connection of the handle and the closure mechanism. The releasable securing means may include a locking member slidably mounted in the housing between a first position in which the handle is movable relative to the closure mechanism and a second position in which the locking member passes through the apertures formed in the handle and the closure mechanism. The releasable securing means may further include means for releasably securing the locking member relative to the housing so as to restrain the locking member from being moved from the second position to the first position.

The locking member may comprise a pin passing through the apertures in the handle and the closure mechanism, the pin further passing through an aperture formed in the housing. The housing may be formed therein with one or more supporting plates formed with an aperture for the passage of the locking pin. The locking member may include a plate secured to an end region of the pin externally of the housing. A further pin may be secured to the plate spaced from the locking pin and may extend into the housing through an aperture formed therein so as to maintain alignment of the plate. The lower end of the further pin may be provided with means, such as an O-ring, for preventing removal of the locking member from the housing. The plate forming part of the locking member may be provided with a tab to facilitate movement of the locking member. The plate forming part of the locking member may be formed with an aperture which aligns with an aperture formed in the housing for receiving the releasable securing means. The plate forming part of the locking member may be substantially L-shaped. The aperture formed in the housing may be provided in a plate projecting from the housing.

Additionally or alternatively, the releasable securing means may include a lock, such as a key-operated lock, adapted to move a sliding member into engagement with the locking member.

Alternatively, the housing may enclose the pivotal connection of the handle and may include a plate-like member covering at least a part of the closure mechanism, the releasable securing means bearing against the plate-like member to secure the housing relative to the handle and the closure mechanism.

Two plate-like members may be provided, one extending either side of the handle.

For a better understanding of the present invention and to show more clearly how it may be carried into effect reference will now be made, by way of example, to the accompanying drawings in which:

FIG. 7 is a perspective view of part of the locking arrangement shown in FIG. 6; and FIG. 8 is a perspective view of another part of the locking arrangement shown in FIG. 6.

Figure 1:
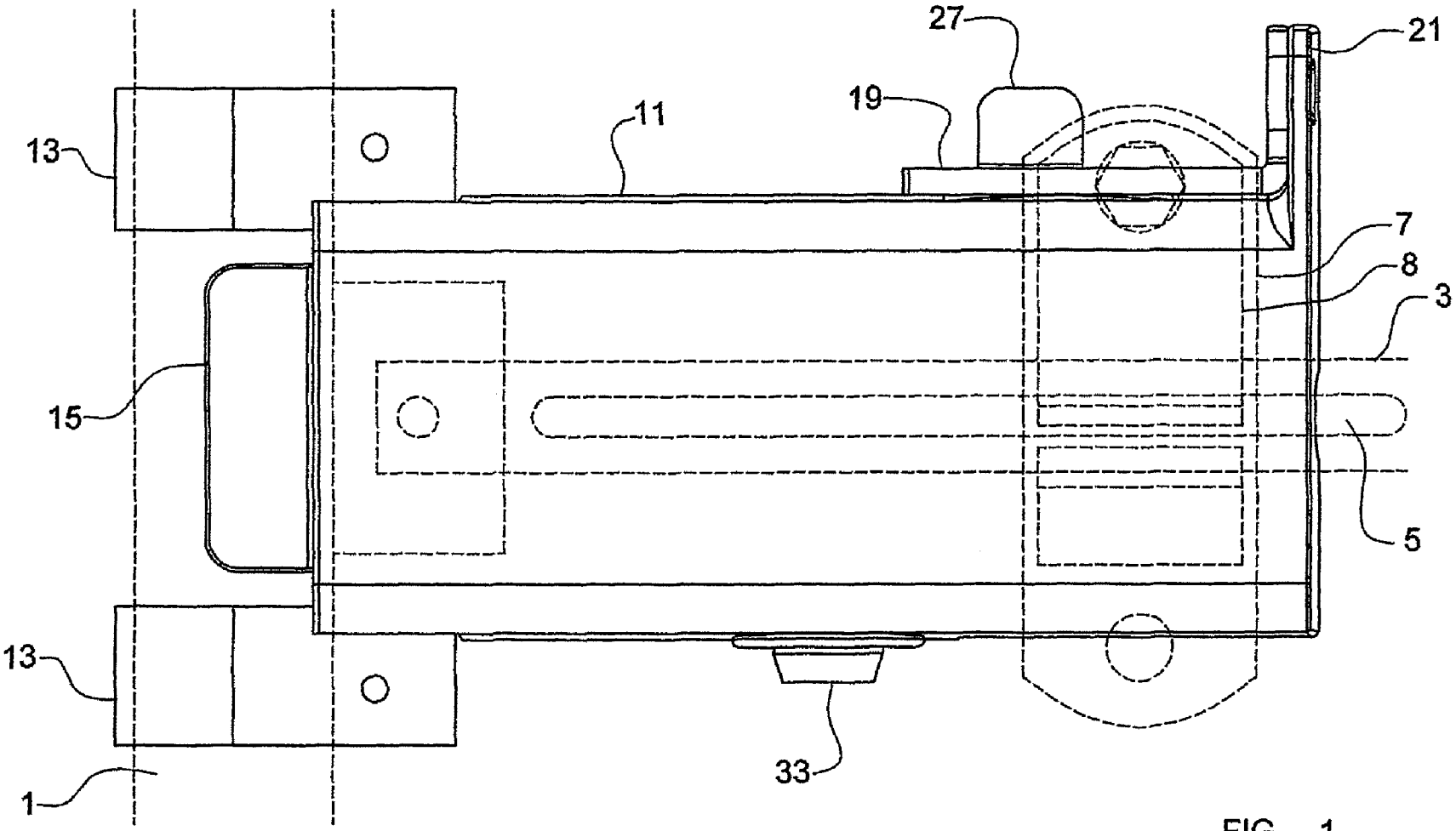
FIG. 1 is a front elevational view of one embodiment of a locking arrangement for a door in accordance with the present invention.
Figure 2:
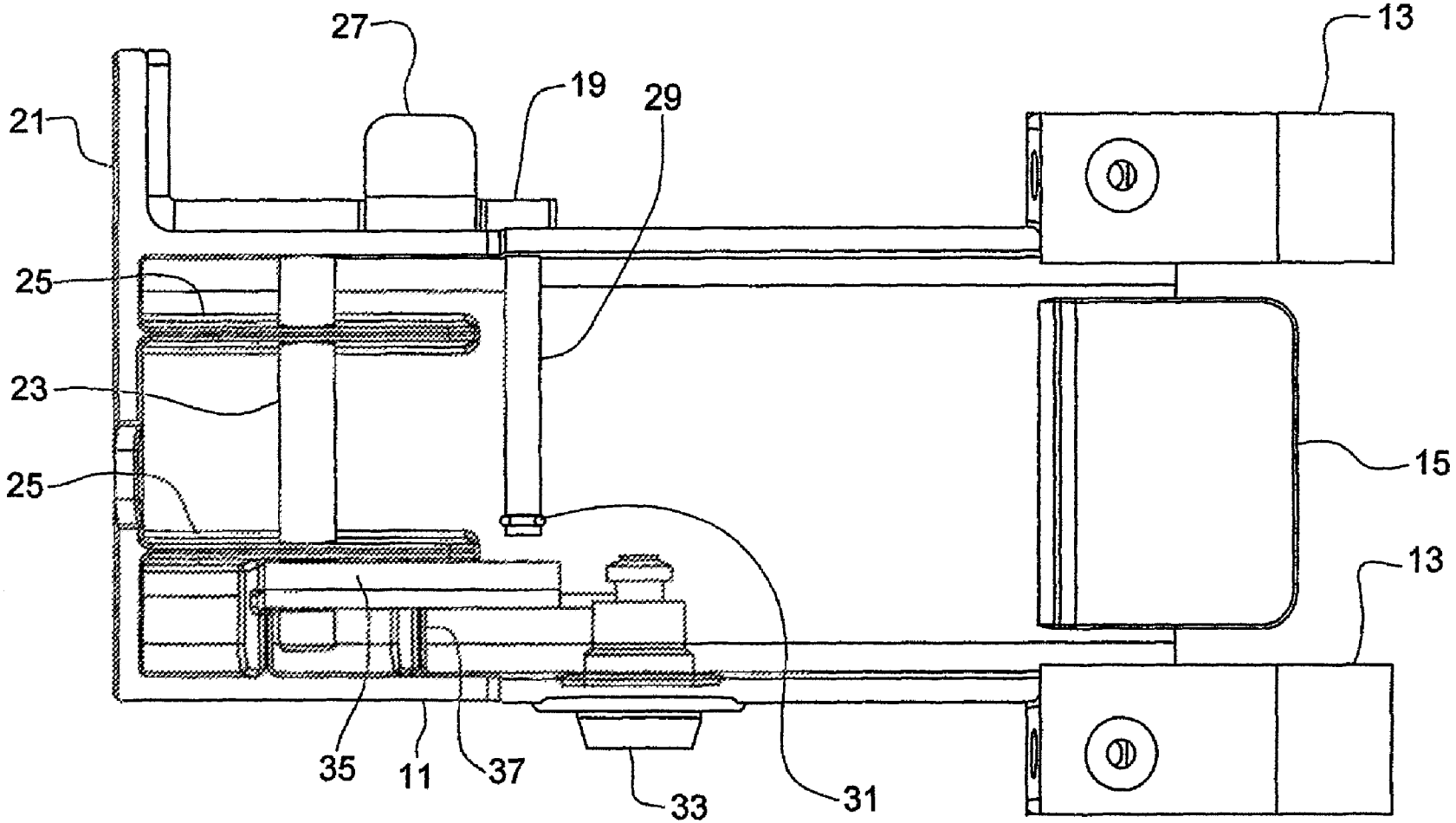
FIG. 2 is a rear elevational view of the locking arrangement shown in FIG. 1.
Figure 3:
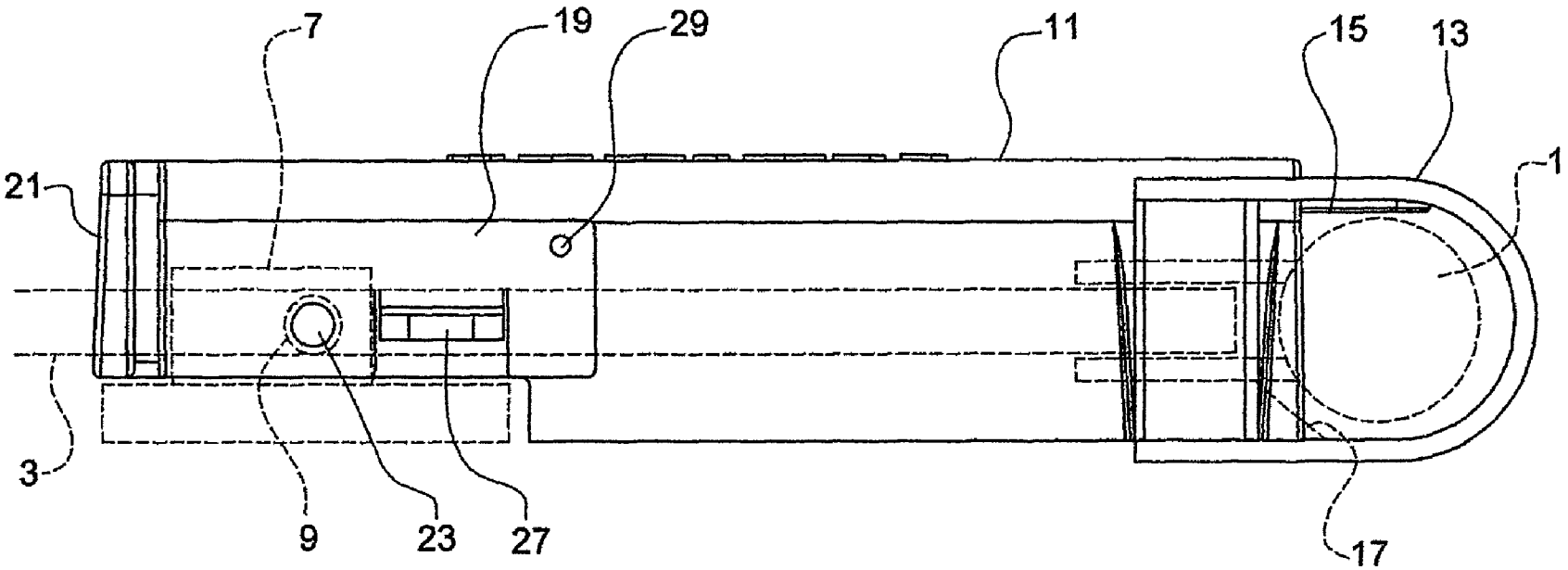
FIG. 3 is a top view of the locking arrangement shown in FIG. 1.
Figure 4:
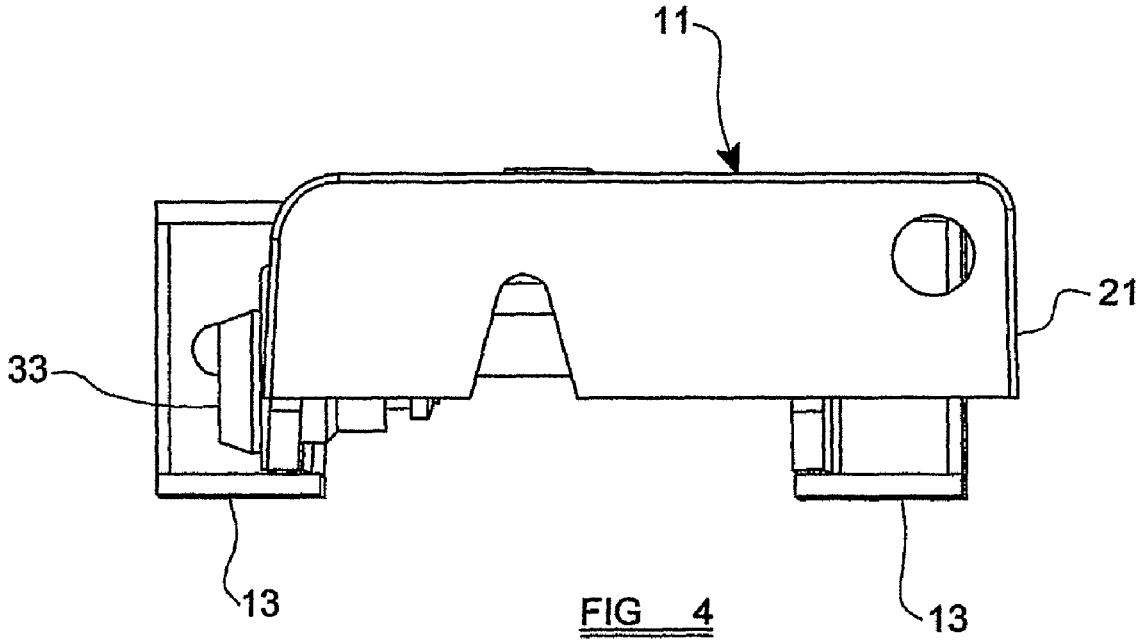
FIG. 4 is a view of the locking arrangement of FIG. 1 from one side.
Figure 5:
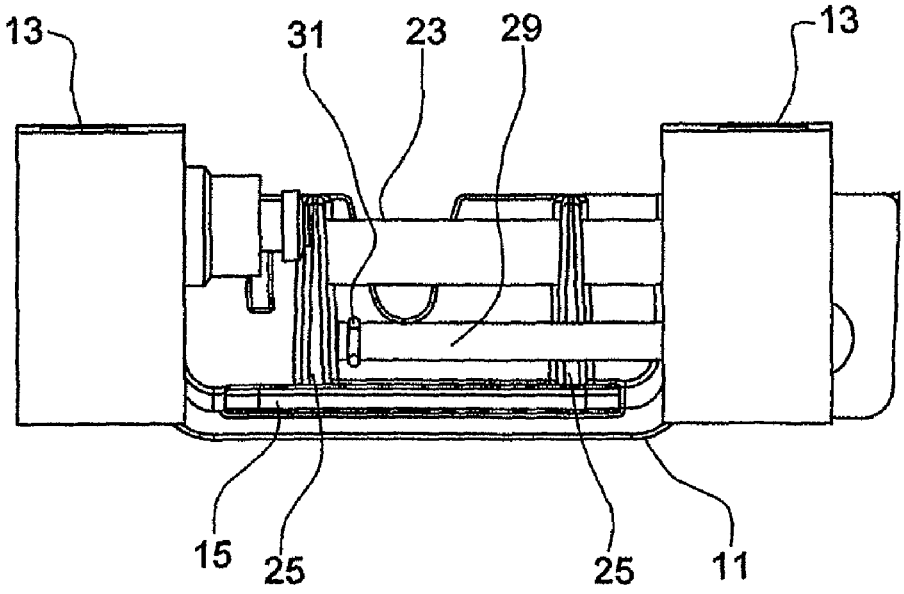
FIG. 5 is a view of the locking arrangement of FIG. 1 from the other side.

FIGS. 1 to 4 show a locking arrangement for a door which, as shown only in FIGS. 1 and 3 and in dashed lines, is adapted for use with a conventional fastening mechanism. The conventional locking mechanism includes an upright operating bar 1 having a handle 3 pivotable mounted thereon. The handle includes a forwardly extending flange 5 so as to form a substantially T-shaped cross-section. The lower portion of the handle is received in a recess formed in a retainer 7, while a swivel catch 8 is pivotably secured to the retainer and swivels downwardly in use to cover the upper portion of the handle 3 and the top and outer edge of the flange 5. The swivel catch 8 and the flange 5 of the handle are formed with co-operating apertures 9 for receiving in normal use a releasable locking mechanism in the form, for example, of the hasp of a padlock or a TIR seal which is conventionally removed for example with bolt cutters. Further details of such a fastening mechanism are shown, for example, in GB-A-2 314 585.

The locking arrangement comprises a housing 11 which is generally in the form of a hollow rectangular box which is open at one face which is adapted to be positioned against the face of the door (not shown). An end face of the housing 11 may also be open in the region of the operating bar 1.

That end of the housing in the region of the operating bar is optionally provided with two U-shaped members 13 which extend around the operating bar 1 such that the housing is pivotably mounted on the operating bar 1. If desired, however, the U-shaped members may be omitted or the housing 11 could extend beyond the operating bar so that the operating bar passes through the housing, the housing being pivotably mounted on the face of the door at a convenient point beyond the operating bar.

The forward face of the housing 11 is provided with a protective plate 15 which as illustrated extends between the U-shaped members 13 and at least partly across the operating bar 1 to prevent any interference where the handle 3 is pivotably mounted on the operating bar 1. Thus, should a thief seek to drill out the pivot for the handle or separate the mounting for the handle from the operating bar, not only will such operations be difficult to carry out, but additionally it will be necessary to damage the housing in a manner which will be readily apparent by visual inspection.

Furthermore, where one or both of the U-shaped members 13 passes behind the operating bar 1 a shaped retaining member 17 may be positioned within the U-shaped member 13 so as to provide a reinforcing component which extends behind the operating bar 1 and acts in the manner of a jaw such that, if a thief should seek to cut through the front face of the U-shaped members 13, the shaped retaining member 17 is more difficult to gain access to than is the front face and is more difficult to cut than is the front face of the U-shaped members 13. The shape of the retaining member 17 may be triangular, for example, when viewed from above.

The end of the housing 11 remote from the operating bar 1 covers the retainer 7, while allowing the free end of the handle 3 to protrude from the wall at the free end of the housing 11. Slidably mounted in the upper wall of the housing 11 is a closure device. The closure device comprises an L-shaped plate 19 positioned externally of the upper wall of the housing 11 with a leg of the plate extending upwardly and adjacent to a complementary plate 21 from the end of the housing 11. Both the closure plate and the complementary plate are provided with corresponding apertures to receive, for example, the hasp of a padlock or a TIR seal. The closure plate 21 is movable towards and away from the upper wall of the housing 11 by means of a pin 23 which extends through an aperture provided in the upper wall and through apertures formed in two spaced supporting plates 25 within the housing. An upstanding tab 27 is formed on the closure plate 19 to assist moving the plate 19 relative to the housing 11. The pin 23 passes in use through the aperture 9 formed in the forwardly extending flange 5 of the handle 3 so as to secure the handle within the housing in a secure manner which also facilitates ready visual confirmation.

In order to maintain the closure plate 19 in alignment with the housing 11, a further pin 29 extends from the closure plate and through the upper wall of the housing 11, the further pin 29 being spaced from the locking pin 23. The lower end of the pin 29 is formed with an annular groove into which is fitted an O-ring 31 or the like which is too large to pass through the aperture in the upper wall of the housing and therefore prevents the closure plate 19 from being separated from the housing. There is no need for the further pin 29 to pass through the supporting plates 25 and in any event in such a case the O-ring could inhibit the closure plate being lifted away from the upper wall of the housing 11 to such an extent that the pin 23 can enter and exit the aperture 9 in the handle 3. The further pin 29 is advantageously positioned further to the front wall of the housing 11 than the locking pin 23 to facilitate the passage of the handle 3 through the housing.

The upper and lower walls of the housing are formed with recesses in the region of the end of the housing remote from the operating bar 1 in order to accommodate the retainer 7 for the door.

While the housing has been described with the closure plate 19 at the top of the housing 11, the closure plate could equally be provided at the bottom of the housing.

For tracking purposes, if desired GSM and/or GPS systems may be incorporated into the housing 11.

If desired, the housing may incorporate a key-operated lock 33 or other similar lock which is linked to a sliding arm 35 within the lower region or the housing 11 for engaging with a recess formed in the lower region of the locking pin 23.

When engaged, the sliding arm prevents the closure plate 19 being lifted away from the upper wall of the housing 11. The sliding arm 35 may slide between a lower one of the supporting plates and one or more supports 37 extending upwardly from the lower wall of the housing 11. The lock 33 may be employed as an alternative to the apertures in the closure plate 19 and the corresponding plate 21 or may provides a further level of security for the lock arrangement according to the present invention.

In use of the locking arrangement according to the present invention, the door is locked by first closing the door, pivoting the handle 3 downwardly to engage with the recess formed in the retainer 7, and then lowering the swivel catch 8 to engage around the upper region of the handle. The housing 11 is then pivoted towards the door face and the closure plate 19 is lifted to enable the locking pin 23 to pass over the handle 3 and part of the retainer 7. The closure plate, and therefore the locking pin, is then lowered such that the locking pin 23 passes through the apertures formed in the swivel catch 8 and the flange of the handle 3 so as to ensure the handle cannot be moved until the housing has been opened. The hasp of a padlock, or a TIR seal, is then passed through the corresponding apertures formed in the plates 19 and 21 and/or the lock 33 may be secured.

Opening of the door is effectively the reverse of the locking procedure and the only component that is destroyed is the TIR or like seal if used.

Figure 6:
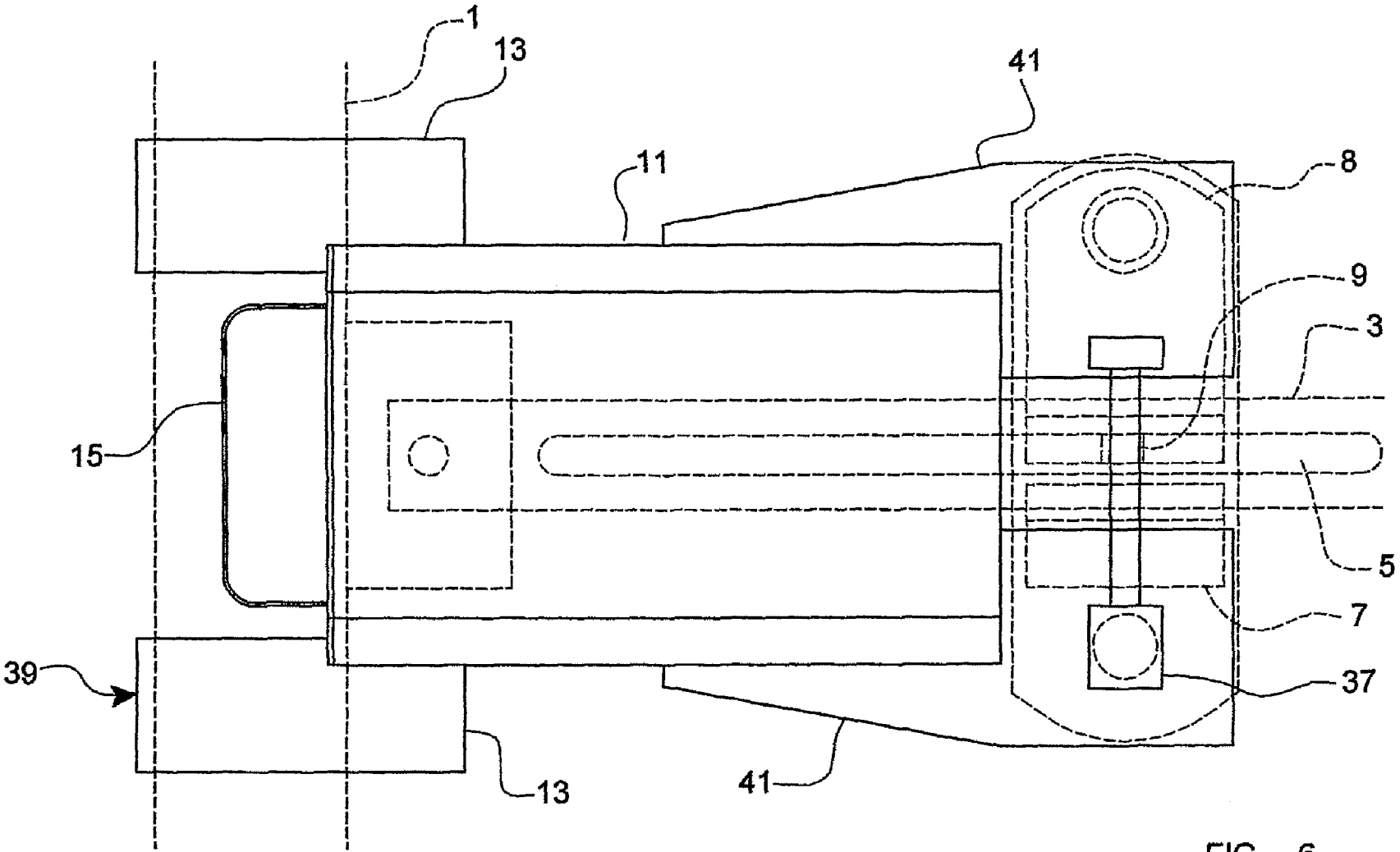
FIG. 6 is a front elevational view of another embodiment of a locking arrangement for a door in accordance with the present invention.

The locking arrangement shown in FIGS. 6 to 8 is a modification of that shown in FIGS. 1 to 4 and the same references are use to denote the same or similar parts. The locking arrangement of FIGS. 6 to 8 differs from that of FIGS. 1 to 4 in the manner in which the housing 11 is locked.

FIG. 6 shows a conventional locking mechanism which includes an upright operating bar 1 having a handle 3 pivotable mounted thereon. The handle includes a forwardly extending flange 5 so as to form a substantially T-shaped cross-section. The lower portion of the handle is received in a recess formed in a retainer 7, while a swivel catch 8 is pivotably secured to the retainer and swivels downwardly in use to cover the upper portion of the handle 3 and the top and outer edge of the flange 5. The swivel catch 8 and the flange 5 of the handle are formed with co-operating apertures 9 for receiving in normal use the hasp of a padlock or a TIR seal 37.

The locking arrangement comprises a housing 11 which is generally in the form of a hollow rectangular box which is open at one face which is adapted to be positioned against the face of the door (not shown). An end face of the housing 11 may also be open in the region of the operating bar 1.

Secured to that end of the housing in the region of the operating bar is a securing member 39 provided with two U-shaped members 13 which extend around the operating bar 1 such that the housing is pivotably mounted on the operating bar 1. If desired, however, the U-shaped members may be omitted or the housing 11 could extend beyond the operating bar so that the operating bar passes through the housing, the housing being pivotably mounted on the face of the door at a convenient point beyond the operating bar.

The forward face of the housing 11 is provided with a protective plate 15 which as illustrated extends between the U-shaped members 13 and at least partly across the operating bar 1 to prevent any interference where the handle 3 is pivotably mounted on the operating bar 1. Thus, should a thief seek to drill out the pivot for the handle or separate the mounting for the handle from the operating bar, not only will such operations be difficult to carry out, but additionally it will be necessary to damage the housing in a manner which will be readily apparent by visual inspection.

Furthermore, where one or both of the U-shaped members 13 of the securing member 39 passes behind the operating bar 1 a shaped retaining member 17 may provide a reinforcing component which extends behind the operating bar 1 and acts in the manner of a jaw such that, if a thief should seek to cut through the front face of the U-shaped members 13, the shaped retaining member 17 is more difficult to gain access to than is the front face and is more difficult to cut than is the front face of the U-shaped members 13.

The end of the housing 11 remote from the operating bar 1 terminates short of the retainer 7, but is provided with two plates 41 which extend in spaced-apart manner along the upper and lower sides of the handle 3 so as to cover the retainer 7 and the swivel catch 8 while allowing access to the openings 9 so as to permit a TIR seal 37 or the like to be passed through the openings with the seal bearing against the outer faces of the plates 41. In this way, the TIR seal 37 or the like prevents the housing 11 being moved, while the plates 41 prevent access to the swivel catch 8 and retainer 7. There is a certain amount of pivoting movement available for the housing 11 before the seal 37 or the like is inserted to allow access to the swivel catch 8 to allow the catch to be manipulated into place or released as the case may be, but insertion of the seal 37 or the like then inhibits any such pivoting movement.

For tracking purposes, if desired GSM and/or GPS systems may be incorporated into the housing 11.

The invention claimed is:

1. A locking arrangement for a door, the locking arrangement including an upright operating bar (1) mounted on the door for angular movement about its axis and a handle (3) which is connected to the operating bar by a pivotal connection for engagement with a closure mechanism (7, 8), the handle and the closure mechanism including co-operating apertures (9), characterised in that the locking arrangement further comprises:

a housing (11) adapted to cover the pivotal connection of the handle and at least a part of the closure mechanism; and a releasable securing means (19, 23) passing through apertures formed in both the handle and the closure mechanism and securing the housing relative to the handle and the closure mechanism;

wherein the housing substantially encloses both the pivotal connection of the handle and the closure mechanism; and the releasable securing means includes a locking member slidably mounted in the housing between a first position in which the handle is movable relative to the closure mechanism and a second position in which the locking member passes through the apertures formed in the handle and the closure mechanism, the locking member comprising:

a locking pin passing through the apertures (9) in the handle (3) and the closure mechanism (7, 8), the locking pin further passing through an aperture formed in the housing (11);

a plate (19) secured to an end region of the pin externally of the housing (11); and a further pin (29) secured to the plate (19) spaced from the locking pin and which extends into the housing (11) through an aperture formed therein so as to maintain alignment of the plate (19).

2. A locking arrangement as claimed in claim 1, characterised in that the lower end of the further pin (29) is provided with means (31) for preventing removal of the locking member (23) from the housing (11).

3. A locking arrangement as claimed in claim 1, characterised in that the plate (19) forming part of the locking member (23) is provided with a tab (27) to facilitate movement of the locking member.

4. A locking arrangement as claimed in claim 1, characterised in that the plate (19) secured to the pin (23) is formed with an aperture which aligns with an aperture formed in the housing (11) for receiving the releasable securing means (19, 23).

5. A locking arrangement as claimed in claim 4, characterised in that the aperture formed in the housing (11) is provided in a plate (21) projecting from the housing (11).

6. A locking arrangement as claimed in claim 1, characterised in that the plate (19) forming part of the locking member (23) is substantially L-shaped.

7. A locking arrangement for a door, the locking arrangement including an upright operating bar (1) mounted on the door for angular movement about its axis and a handle (3) which is connected to the operating bar by a pivotal connection for engagement with a closure mechanism (7, 8), the handle and the closure mechanism including co-operating apertures (9), characterised in that the locking arrangement further comprises:

a housing (11) pivotably mounted on the operating bar (1) and adapted to cover the pivotal connection of the handle and at least a part of the closure mechanism; and a releasable securing means (19, 23) passing through apertures formed in both the handle and the closure mechanism and securing the housing relative to the handle and the closure mechanism characterised in that the housing (11) encloses the pivotal connection of the handle (3) and includes a plate (41) covering at least a part of the closure mechanism (7, 8), the releasable securing means bearing against the plate member to secure the housing relative to the handle and the closure mechanism; and characterised in that two plates (41) are provided, one extending either side of the handle (3).

* * * * *